US005786671A

United States Patent [19]

Lee

[11] Patent Number: 5,786,671

[45] Date of Patent: Jul. 28, 1998

[54] ELECTRONIC BALLAST CIRCUIT HAVING VOLTAGE REDUCING TRANSFORMER

[75] Inventor: Kyoung-Geun Lee, Ahnsan, Rep. of Korea

[73] Assignee: Samsung Electronics Co., Ltd., Kyungki-Do, Rep. of Korea

[21] Appl. No.: 748,496

[22] Filed: Nov. 8, 1996

[30] Foreign Application Priority Data

Nov. 10, 1995 [KR] Rep. of Korea ..... 40647/1995
Oct. 8, 1996 [KR] Rep. of Korea ..... 44568/1996

[51] Int. Cl.[6] ..... G05F 1/00

[52] U.S. Cl. ..... 315/307; 315/308; 315/224; 315/247; 315/DIG. 7

[58] Field of Search ..... 315/307, 308, 315/209 R, 291, 244, 282, DIG. 7, 224, 247

[56] References Cited

U.S. PATENT DOCUMENTS 4,277,728 7/1981 Stevens ..... 315/307
4,777,409 10/1988 Tracy et al. ..... 315/200 R
5,491,387 2/1996 Saito ..... 315/307
5,528,111 6/1996 Konopka et al. ..... 315/291

*Primary Examiner*—Benny Lee
*Assistant Examiner*—Haissa Philogene
*Attorney, Agent, or Firm*—Sughrue, Mion, Zinn, Macpeak & Seas, PLLC

[57] ABSTRACT

An AC or DC electronic lamp-driving ballast circuit which prevents the generation of harmonic currents. The ballast circuit includes a filter for receiving and filtering an AC voltage, a ripple transformer for converting the AC voltage into a unilateral ripple voltage, and a voltage reducing transformer for pulse-width-modulating, using a modulation signal generated by a power controller, the ripple voltage into a reduced DC voltage to be transferred to the lamp. A power controller feedback-amplifies the reduced voltage, a sensing voltage of the ripple voltage, and a current sensing voltage supplied from the lamp, and then generates, using the amplified voltage, the pulse width modulation signal used by the voltage reducing transformer. A trigger generator generates high voltage trigger pulses in order to induce an initial discharge in the lamp so that the lamp may be turned on.

7 Claims, 5 Drawing Sheets

ELECTRONIC BALLAST CIRCUIT HAVING VOLTAGE REDUCING TRANSFORMER

BACKGROUND OF THE INVENTION

1. Field of the Invention

The present invention relates to an electronic ballast circuit having a voltage reducing transformer in its power circuit, and more particularly, to an AC or DC electronic ballast circuit which minimizes harmonic current components of a commercial frequency generated at a power input port. The present application is based upon Korean Application Nos. 40647/1995 and 44568/1996, which are incorporated herein by reference.

2. Description of the Related Art

There are many types of electronic ballast circuits having a voltage reducing transformer. A representative example is a circuit for driving a lamp, such as a lamp for irradiating light in a liquid crystal display device used in a projection television. In order to drive the lamp, a predetermined power, which is controlled in various ways, should be supplied.

FIG. 1 is a schematic diagram illustrating the construction of a power circuit in a prior art AC lamp driving ballast. Its configuration and operation will be described hereinbelow.

When an AC input power VI passes through a full-wave rectifier 12 via a filter 11 comprised of a fuse F1 and a coil L1, a first DC voltage $V_{DC1}$ is generated. Here, a full-wave rectifier is used in the case of 220 V, and a voltage doubler circuit is used to convert the first DC voltage to a higher level in the case of 110 V. The full-wave rectifier 12 is comprised of bridge diodes D11 through D14 and a capacitor C11. A general voltage reducing transformer 13 comprised of a field effect transistor (hereinafter, "FET") Q1, a diode D1, a coil L2 and a capacitor C1 modulates a pulse width of the full-wave rectified DC voltage, then to be changed into a second DC voltage $V_{DC2}$ A lamp driver 14 is comprised of FETs Q2 through Q5, and two pairs of FETS, Q2 and Q5, and Q3 and Q4, are controlled in a predetermined way to operate exclusively with respect to one another. In other words, if the former are turned on, the latter are turned off, and vice versa. The lamp driver 14 is controlled in a predetermined way and discerns between a high voltage trigger generation time and a normal state to switch the FETs Q2 through Q5 on and off, thereby driving a lamp LP. During the high voltage trigger generation time, the FETs Q2 and Q5 are turned on, and the FETs Q3 and Q4 are turned off, so that the second DC voltage $V_{DC2}$ can be applied to the lamp LP. During the normal state on the other hand, the pairs of FETS, Q2 and Q5, and Q3 and Q4, are repeatedly switched on and off so that an AC voltage can be applied to the lamp LP.

A power controller 15 is comprised of a pulse width modulation (hereinafter, "PWM") controller 27, a feedback amplifier 28 (an operation amplifier), resistors R34 and R35 and a reference voltage Vref. A lamp current sensing voltage $V_{ise}$ and a third DC voltage $V_{DC3}$ are feedback-amplified and a pulse width modulation signal is outputted through an output port $V_{DOUT}$. The pulse width modulation signal controls an on/off duty of the FET Q1 of the voltage reducing transformer 13, thereby maintaining a constant overall power of the electronic ballast circuit. A resistor $R_{ise}$ is for sensing the resistance to transform an average current of the voltage reducing transformer 13 into a voltage.

A high voltage trigger generator 16, comprised of two boosting transformers T2 and T3, a diode D4, a capacitor C2 and discharge tubes S and G, causes an initial discharge of the lamp LP. A trigger driver 17, comprised of a resistor R4, a capacitor C4 and an FET Q6, controls the operation of the high voltage trigger generator 16. In other words, the second DC voltage $V_{DC2}$ is charged to the capacitor C4 by a time constant of the resistor R4 and capacitor C4. The amount of the electric charge charged to the capacitor C4 is instantaneously discharged when the FET Q6 is turned on. The high voltage trigger generator 16 enables the voltage discharged from the capacitor C4 to be passed through the transformer T3 and the diode D4, to then be charged to the capacitor C2. By repeating these operations, a high potential electric charge is charged to the capacitor C2. If the capacitor C2 is charged high enough to generate a potential difference of a constant size between both terminals of the capacitor C2, an instantaneous spark current will flow through the discharge tubes S and G. This electric charge from the capacitor C2 then quickly passes through a primary coil of the step-up transformer T2. High voltage pulses will then be induced in a secondary coil of the boosting transformer T2 to generate a high voltage in both terminals of the lamp LP. Finally, the high voltage trigger pulses cause an initial discharge to occur in the lamp LP, and thus cause the lamp LP to be turned on.

Before the lamp LP is discharged, the first and second DC voltages VDC, and $V_{DC2}$ are equal to one another. However, if a lamp LP discharge is initiated by the high voltage trigger pulses, the second DC voltage $V_{DC2}$ becomes lower than the first DC voltage $V_{DC1}$. At this time, the power controller 15 causes the second DC voltage $V_{DC2}$ to become lower than the first DC voltage $V_{DC1}$ via the voltage reducing transformer 13, thereby allowing the current flowing in the lamp LP to be maintained constant.

The electronic ballast circuit converts an AC input power into a DC voltage using a full-wave rectifier. Since the full-wave rectifier uses diodes, a large amount of unwanted third and fifth harmonic currents of the commercial frequency which should be reduced occur in the input current. Also, since the voltage $V_{DC2}$ outputted from the voltage reducing transformer must be maintained to be as high as the DC voltage for a constant time during a trigger period, the capacitor C1 provided in the voltage reducing transformer must have a high internal voltage capacity. Further, the prior art AC lamp driving ballast requires lots of elements to drive a DC lamp. Thus, the manufacturing cost is high and the mounting size is inefficient.

SUMMARY OF THE INVENTION

It is an object of the present invention to provide an AC or DC electronic ballast circuit using a diode rectification system which can prevent the generation of harmonic currents.

To accomplish the above object, an electronic ballast circuit connected to a predetermined loading unit according to the present invention includes a filter for inputting an AC commercial frequency voltage and line-filtering the inputted AD commercial frequency voltage; a unit for converting the line-filtered voltage into a unilateral ripple voltage; a reducing transformer for pulse-width-modulating the ripple voltage by a predetermined control to generate a reducing DC voltage to be matched to the loading unit and transferring the generated voltage to the loading unit; a trigger generator for generating a high voltage trigger pulses by a predetermined control in order for the loading unit to induce an initial discharge; a power controller for generating a pulse width modulation signal for performing reducing transformation, feedback-amplifying the reducing voltage, a sensing voltage of a ripple voltage, and a current sensing voltage supplied from the loading unit, and controlling the generation of the pulse width modulation signal by the amplified voltage; and a trigger driver for charging the line-filtered voltage and then being instantaneously discharged by a predetermined control to drive the trigger generator.

BRIEF DESCRIPTION OF THE DRAWINGS

The above object of the present invention will become more apparent by describing in detail preferred embodiments thereof with reference to the attached drawings in which.

DETAILED DESCRIPTION OF THE PREFERRED EMBODIMENT

A preferred embodiment of the present invention will be described in detail with reference to accompanying drawings. Please note that the same symbols are used for the same components in the various figures. Many specific details such as circuit components will be introduced to aid the overall understanding of the present invention, but it should be apparent to any one skilled in the art that without those specific details this invention can be carried out. Details and explanations of related techniques as well as the composition of the preferred embodiment will be omitted when such details detract from the understanding of the essence of the invention.

Figure 1:
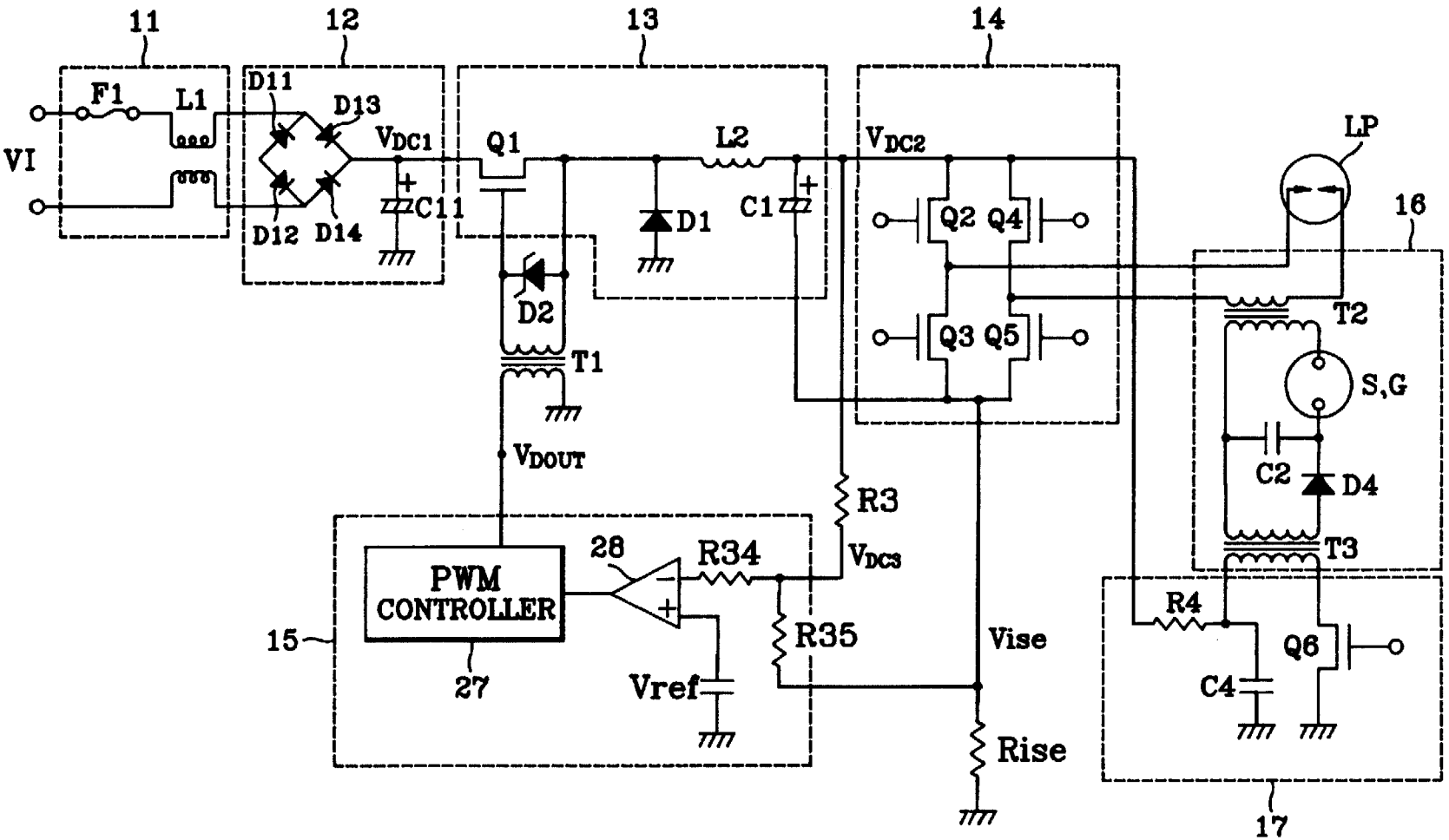
(PRIOR ART) Fig. 1
FIG. 1 is a schematic diagram illustrating the construction of a power circuit in a prior art AC lamp driving ballast.
Figure 2:
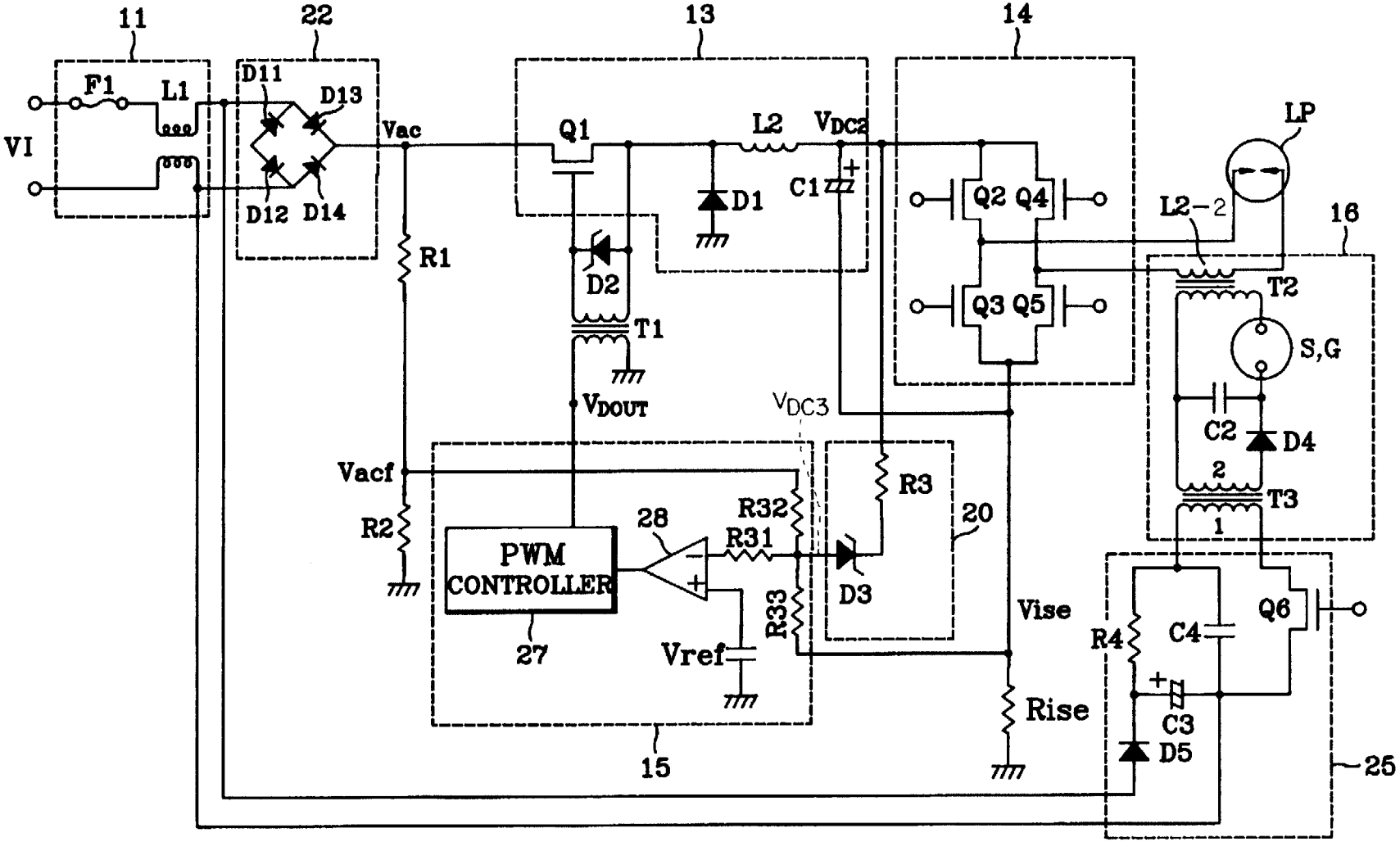
FIG. 2 is a schematic diagram illustrating the construction of an AC lamp driving electronic ballast circuit according to an embodiment of the present invention.
Figure 3A:
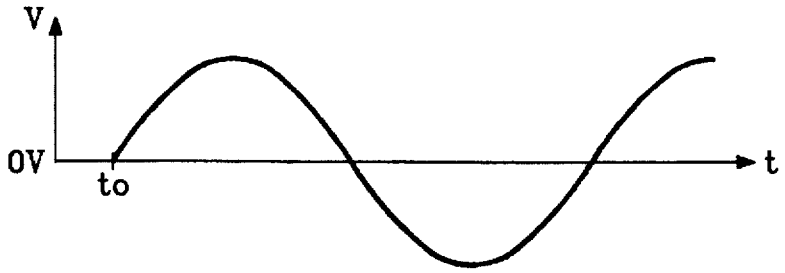
FIGS. 3A-3F are operational waveform diagrams according to an embodiment of the present invention.
Figure 3B:
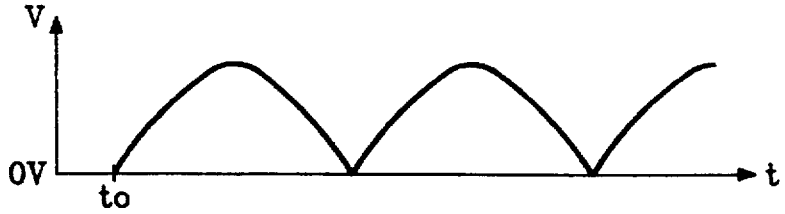
Figure 3C:
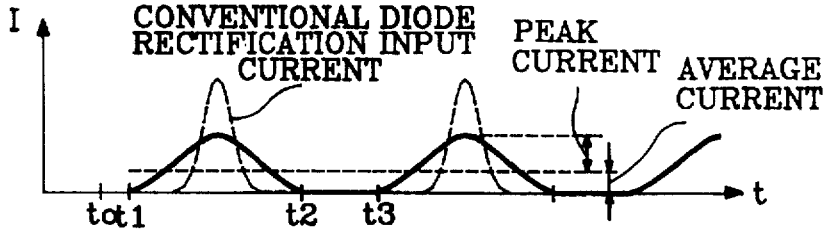
Figure 3D:
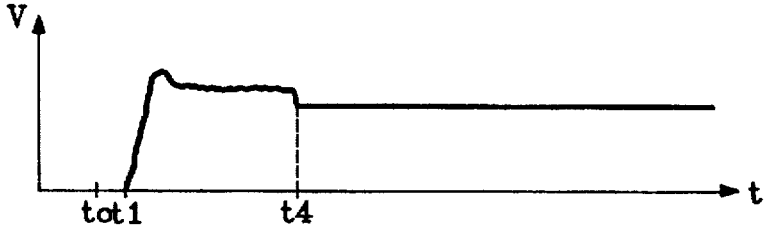
Figure 3E:
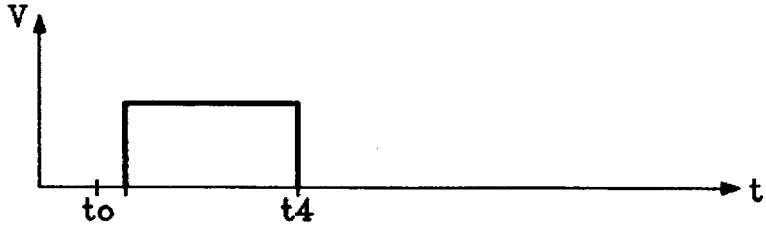
Figure 3F:
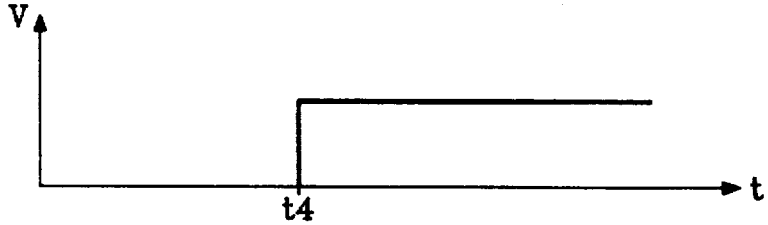

FIG. 2 is a schematic diagram which illustrates the construction of an AC lamp driving electronic ballast circuit according to an embodiment of the present invention, and FIGS. 3A–3F illustrate operational waveform diagrams according to this embodiment. FIG. 3A illustrates a waveform diagram of an input power voltage VI, FIG. 3B illustrates a waveform diagram of a first ripple voltage $V_{ac}$, FIG. 3C illustrates a waveform diagram of a current waveform depending on the first ripple voltage $V_{ac}$, FIG. 3D illustrates a waveform diagram of a second DC voltage $V_{DC2}$, FIG. 3E illustrates a waveform diagram during a trigger pulse generation period, and FIG. 3F illustrates a waveform diagram of a lamp current sensing voltage $V_{ise}$.

Referring to FIGS. 3A–3F, the configuration and operation of a harmonic current suppressing electronic ballast circuit for preventing the harmonics current from being generated according to an embodiment of the present invention will be described hereinbelow.

An input commercial AC voltage VI passes through bridge diodes D11 through D14 of a ripple transformer 22 via a filter 11, comprised of a fuse F1 and a coil L1, to then be converted into a first ripple voltage $V_{ac}$. While the commercial AC voltage VI is bi-lateral, as shown in FIG. 3A, the first ripple voltage $V_{ac}$ outputted from the bridge diodes D11 through D14 is unilateral, as shown in FIG. 3B.

The voltage reducing transformer 13 which is comprised of a FET Q1, a diode D1, a coil L2 and a capacitor C1, modulates the pulse width of the first ripple voltage $V_{ac}$ into a reduced voltage, the second DC voltage $V_{DC2}$. Thus, the second DC voltage $V_{DC2}$ is generated by a voltage reducing transformer 13 comprising a reducing FET Q1, a reducing transforming diode D1, a reducing coil L2, and a reducing capacitor C1. If the voltage reducing transformer 13 receives a pulse output from a power controller 15 via an output port $V_{DOUT}$ at a gate of the FET Q1 via a gate driving transformer T1, the FET Q1 is turned on when the potential difference between the gate and the source is in a logical high state, and the FET Q1 is turned off when the potential difference between the gate and the source is in a logical low state. Thus, the first ripple voltage $V_{ac}$ is applied to the coil L2 as a pulse voltage, during which the current is charged to the capacitor C1 by the coil L2 to obtain a constant voltage. If the FET Q1 is turned off, a reverse electromotive force of the coil L2 is generated to thereby turn on the diode D1 so that the excited power of the coil L2 can be transferred to the capacitor C1, which obtains a constant DC voltage. This is a well-known reducing transformation. However, if the first ripple voltage $V_{ac}$ is lower than the second DC voltage $V_{DC2}$, the aforementioned operation does not occur, nor does the current flow. Thus, referring to FIG. 3C, the current does not flow during a period between t2 and t3. In order to remove a ripple from the second DC voltage $V_{DC2}$ during this period, the capacitor C1 must have a large capacitance.

A lamp driver 14 is comprised of FETs Q2 through Q5, and discriminates between a high voltage trigger generation time and a normal state by a predetermined control in order to switch the FETs Q2 through FET Q5 on and off, thereby driving the lamp LP. That is, the FETs Q2 and Q5 are turned on during the high voltage trigger generation time and the FETs Q3 and Q4 are turned off, thereby applying the second DC voltage $V_{DC2}$ to the lamp LP. During the normal state on the other hand, the FET pairs, Q2 and Q5, and Q3 and Q4, are repeatedly switched on and off, thereby applying an AC voltage to the lamp LP. At this time, the influence of the secondary winding coil L2-2 of the boosting transformer T2 on the current sensing voltage $V_{ise}$ of the discharge lamp is negligible.

The power controller 15 is comprised of a PWM controller 27, a feedback amplifier 28, resistors R31 through R33 and a reference voltage $V_{ref}$. The power controller 15 receives the current sensing voltage $V_{ise}$ of the lamp LP and a third DC voltage $VDC_3$ as a sensing voltage of a secondary DC current of $V_{DC2}$ and generates an on/off pulse via the output port $V_{DOUT}$. This pulse controls an on/off duty of the FET Q1 so that the power of the lamp LP can be controlled. In other words, the on/off pulse supplied to the primary coil of the first transformer T1 is induced to the secondary coil to turn the FET Q1 on and off. At this time, a Zener diode D2 connected between both terminals of the secondary coil of the first transformer T1, i.e., the gate and the source of the FET Q1, is maintained at a constant voltage.

A voltage regulator 20 which is connected between the voltage reducing transformer 13 and the power controller 15, prevents an abnormal increase in the second DC voltage $V_{DC2}$ from being generated. In other words, the voltage regulator 20 checks whether or not the second DC voltage $VDC_2$ becomes higher by a constant degree. If an abnormal voltage is detected, the voltage ballast 20 notifies the power controller 15 to stop the operation. The voltage ballast 20 is comprised of a Zener diode D3 and a resistor R3.

A high voltage trigger generator 16 generates a high trigger voltage in order to induce an initial discharge before a normal discharge of the lamp LP. The high voltage trigger generator 16 is comprised of two transformers T2 and T3, a diode D4, a capacitor C2 and discharge tubes S and G.

A trigger driver 25 is comprised of a resistor R4, a capacitors C3 and C4, an FET Q6 and a diode D5. The trigger driver 25 stores the filtered voltage and then instantaneously discharges the stored filter voltage to drive the trigger generator 16. The amount of the electric charges charged to the capacitor C4 by the time constant of the resistor R4 and the capacitor C4 is instantaneously discharged when the FET Q6 is turned on. The capacitor C3 and the diode D5 rectifies a voltage outputted via the filter 11.

Initially, even if the second DC voltage $V_{DC2}$ is applied to the discharge lamp LP, the discharge is not initiated. In order to initiate the discharge, the following operation is performed. The voltage discharged from the capacitor C4 is charged to the capacitor C2 after passing through the diode D4 via the transformer T3. By repeating these operations, the high potential electric charge is charged to the capacitor C2. If both terminals of the capacitor C2 are charged with an electric potential having a constant magnitude, an instantaneous spark current can be sent through the discharge tubes S and G. Thus, the electric charge charged to the capacitor C2 is discharged for a short time after passing through the primary coil of the boosting transformer T2. Then, the high voltage pulses are instantaneously induced to the secondary coil of the boosting transformer T2. The high voltage trigger pulse generates a high voltage in both terminals of the lamp LP. Finally, the initial discharge occurs in the lamp LP by the high voltage trigger pulse, and lighting is initiated.

Figure 4:
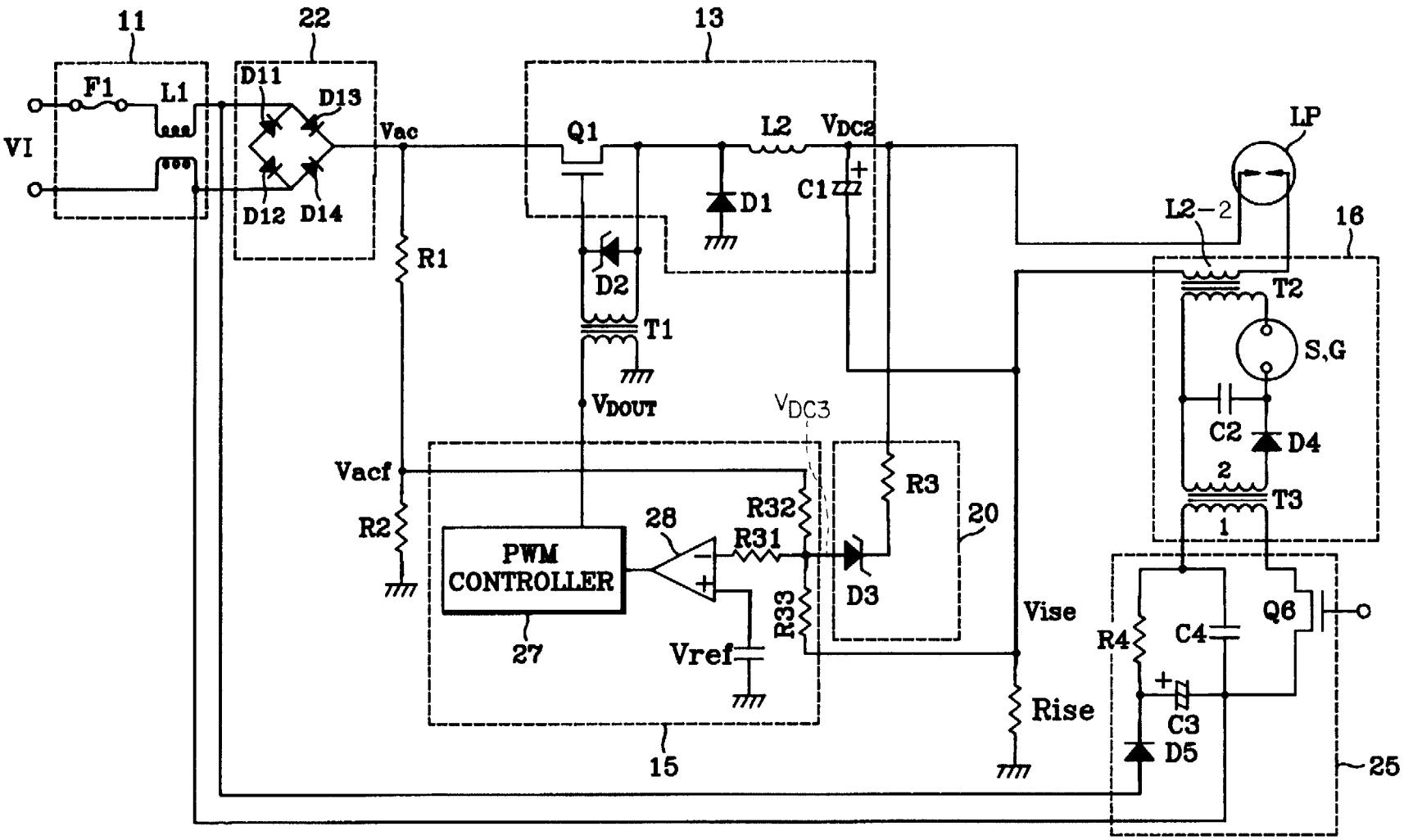
FIG. 4 is a schematic diagram illustrating the construction of an AC lamp driving electronic ballast circuit according to another embodiment of the present invention.

FIG. 4 is a schematic diagram illustrating the construction of an AC lamp driving electronic ballast circuit according to another embodiment of the present invention. FIG. 4 is different from FIG. 2 in that it does not include the lamp driver 14. The second DC voltage $VDC_2$ generated in the voltage reducing transformer 13 is directly applied to both terminals of the lamp LP.

Figure 5:
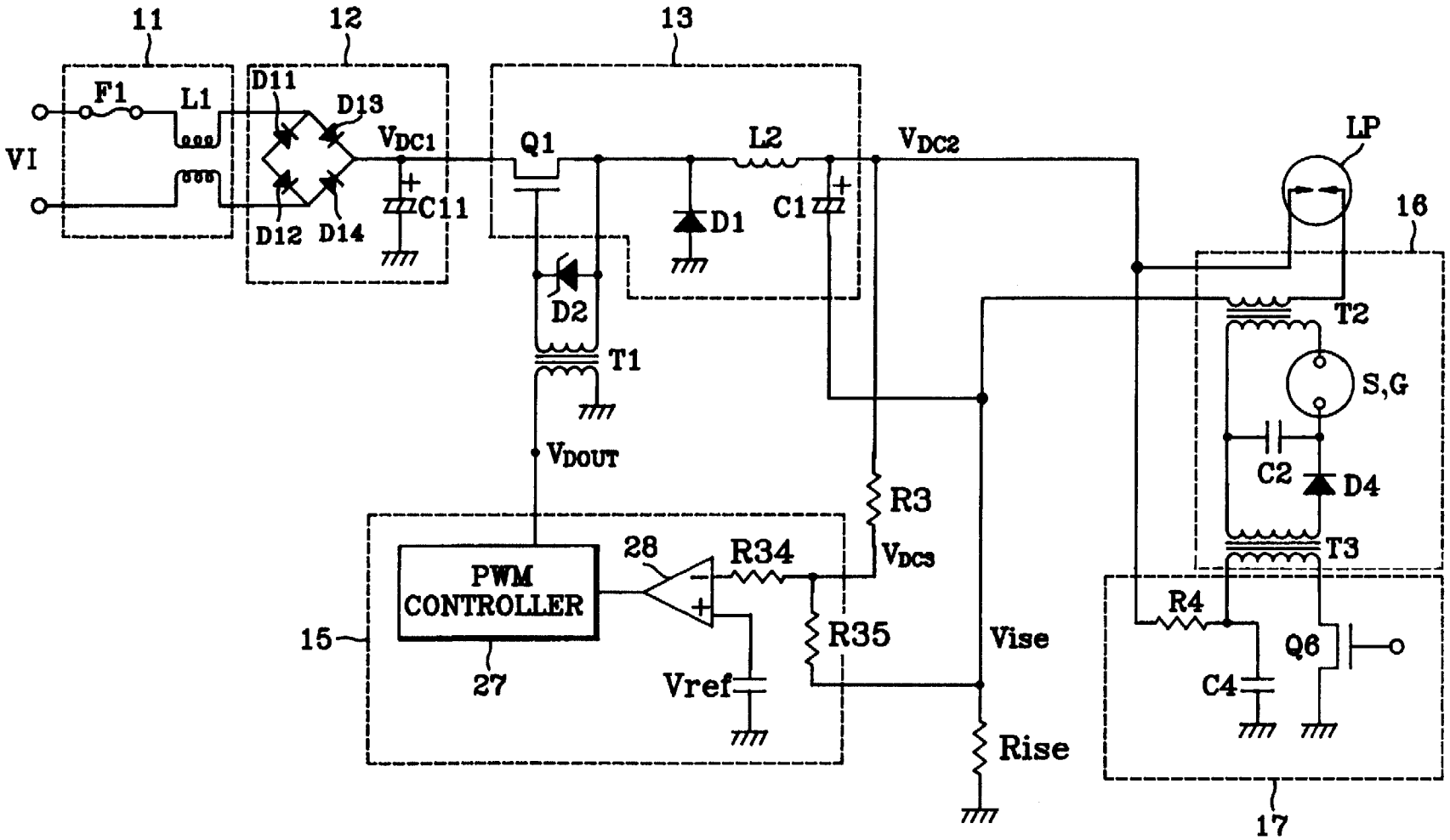
FIG. 5 is a schematic diagram illustrating the construction of an AC lamp driving electronic ballast circuit according to still another embodiment of the present invention.

FIG. 5 is a schematic diagram illustrating the construction of an AC lamp driving electronic ballast circuit according to still another embodiment of the present invention. If an AC input power VI passes through a full-wave rectifier 12 via a filter 11 comprised of a fuse F1 and a coil L1, a first DC voltage $V_{DC1}$ is generated. A full-wave rectifier is used in the case of 220 V, and a voltage doubler rectifier is used to convert the first DC voltage into a higher level in the case of 110 V. The full-wave rectifier 12 is comprised of bridge diodes D11 through D14 and a capacitor C11. A general voltage reducing transformer 13 comprised of a FET Q1, a diode D1, a coil L2 and a capacitor C1 modulates a pulse width of the full-wave rectified DC voltage to generate a second DC voltage $V_{DC2}$, which is directly applied to both terminals of the lamp LP.

The power controller 15 is comprised of a PWM controller 27, a feedback amplifier 28, resistors R34 and R35 and a reference voltage $V_{ref}$. The power controller 15 receives the current sensing voltage $V_{ise}$ of the lamp LP and a third DC voltage $V_{DC3}$ as a sensing voltage of a secondary DC current of $V_{DC2}$ and generates an on/off pulse via the output port $V_{DOUT}$. This pulse controls an on/off duty of the FET Q1 so that the power of the lamp LP can be controlled. In other words, the on/off pulse supplied to the primary coil of the first transformer T1 is induced to the secondary coil to turn the FET Q1 on and off. At this time, a Zener diode D2 connected between both terminals of the secondary coil of the first transformer T1, i.e., the gate and the source of the FET Q1, is maintained at a constant voltage.

A high voltage trigger generator 16 generates a high trigger voltage in order to induce an initial discharge before a normal discharge of the lamp LP. The high voltage trigger generator 16 is comprised of two transformers T2 and T3, a diode D4, a capacitor C2 and discharge tubes S and G.

A trigger driver 17 is comprised of a resistor R4, a capacitor C4, and an FET Q6. The electric charges charged to the capacitor C4 by the time constant of the resistor R4 and the capacitor C4 are instantaneously discharged when the FET Q6 is turned on. The discharged voltage is charged to the capacitor C2 after passing through the diode D4 via the transformer T3. By repeating these operations, the high potential electric charge is charged to the capacitor C2. If both terminals of the capacitor C2 are charged with an electric potential having a constant magnitude so that the spark current of an instantaneous short state can be sent through the discharge tubes S and G. Thus, the electric charge charged to the capacitor C2 is discharged for a short time after passing through the primary coil of the boosting transformer T2. Then, the high voltage pulses are instantaneously induced to the secondary coil of the boosting transformer T2. The high voltage trigger pulse generates a high voltage in both terminals of the lamp LP. Finally, the initial discharge occurs in the lamp LP by the high voltage trigger pulse, and then the lighting is initiated.

At this time, the first and second DC voltages $V_{DC1}$ and $V_{DC2}$ are the same as one another before the lamp LP is discharged. However, if the lamp LP is initiated to be discharged by the high voltage trigger pulse, the second DC voltage $V_{DC2}$ becomes lower than the first DC voltage $V_{DC1}$. At this time, the power controller 15 causes the second DC voltage $V_{DC2}$ to become lower than the first DC voltage $V_{DC1}$, via the voltage reducing transformer 13, thereby maintaining a constant current flow in the lamp LP.

A diode-type full-wave rectifier containing much harmonic current has a ratio of superficial power to effective power which is at most 0.5–0.65. However, according to the harmonic current suppressing circuit of the present invention, if the ratio of superficial power to effective power is increased to 0.85 or higher, the voltage distortion is eliminated, current noise is reduced, and overall power loss is decreased. Also, by changing a reducing transformation method into a power factor improvement method, a separate circuit for improving a power factor is not needed, thereby decreasing cost. Further, although a high-voltage and large capacitance is required for the diode type full-wave rectifier, a low voltage and large capacitor installed in an output port can be used in the present invention to reduce cost and the size of the circuit. Also, by implementing the electronic ballast as a DC type, the number of required elements can be reduced, resulting in reduced manufacturing cost and the mounting size.

Although the present invention has been described in terms of several preferred embodiments, it will be appreciated that various modifications and changes may be made to these exemplary embodiments without departing from the scope or spirit of the invention. For example, although a lamp driving electronic ballast circuit is implemented by suppressing harmonic current, a circuit using a conventional voltage reducing transformer such as a motor driver can be adopted for all power circuits.

It should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. An electronic ballast circuit connected to a load unit, comprising:

a filter for receiving and filtering an AC voltage;

a means for converting said filtered voltage into a unilateral ripple voltage;

a voltage reducing transformer for pulse-width-modulating said ripple voltage, and for generating and transferring a reduced DC voltage to said load unit;

a trigger generator for generating high voltage trigger pulses for inducing an initial discharge in said load unit;

a power controller for feedback-amplifying a sensing voltage of a current said reduced voltage, a sensing voltage of said ripple voltage, and a current sensing voltage supplied from said load unit, and for generating, using said amplified voltage, a pulse width modulation signal to be used by said voltage reducing transformer; and a trigger driver for storing said filtered voltage and then instantaneously discharging said stored filter voltage to drive said trigger generator.

2. An electronic ballast circuit as claimed in claim 1, wherein said load unit is a lamp.

3. An electronic ballast circuit as claimed in claim 1, further comprising:

a driver, connected between said voltage reducing transformer and said load unit, having two paths operating exclusively with respect one another based on said high voltage trigger pulses, for driving said load unit such that said two paths can apply said DC voltage generated in said voltage reducing transformer to said load unit bilaterally.

4. An electronic ballast circuit as claimed in claim 1, further comprising a voltage ballast connected between said voltage reducing transformer and said power controller, for preventing an abnormal change of said DC voltage generated in said voltage reducing transformer.

5. An electronic ballast circuit connected to load unit, comprising:

a filter for receiving and filtering an AC voltage;

a rectifier for full-wave rectifying said filtered AC voltage and converting said rectified voltage into a DC voltage;

a voltage reducing transformer for pulse-width-modulating said ripple voltage, and for generating and transferring a reduced DC voltage to said load unit;

a trigger generator for generating high voltage trigger pulses, using said reduced DC voltage, for inducing an initial discharge in said load unit;

a power controller for feedback-amplifying a sensing voltage of a current of said reduced voltage, a sensing voltage of said ripple voltage, and a current sensing voltage supplied from said load unit, and for generating, using said amplified voltage, a pulse width modulation signal to be used by said voltage reducing transformer; and a trigger driver for storing said filtered voltage and then instantaneously discharging said stored filter voltage to drive said trigger generator.

6. An electronic ballast circuit as claimed in claim 5, wherein said load unit is a lamp.

7. An electronic ballast circuit as claimed in claim 5, wherein said trigger generator has a discharge tube.

* * * * *